US007725965B2

(12) United States Patent
Sanford-Schwentke

(10) Patent No.: US 7,725,965 B2
(45) Date of Patent: Jun. 1, 2010

(54) PORTABLE STRUCTURE HAVING COLLAPSIBLE FRAME

(76) Inventor: Anthony Sanford-Schwentke, 14 Whiteford Gardens, Pitcable, Inverurie, AB515 OL, Aberdeen, Scotland (GB)

( * ) Notice: Subject to any disclaimer, the term of this patent is extended or adjusted under 35 U.S.C. 154(b) by 41 days.

(21) Appl. No.: 11/445,648

(22) Filed: Jun. 2, 2006

(65) Prior Publication Data

US 2007/0277310 A1 Dec. 6, 2007

(51) Int. Cl.
*A45F 3/24* (2006.01)

(52) U.S. Cl. ..... 5/128; 5/127; 5/120

(58) Field of Classification Search ..... 5/127–130, 5/120–122

See application file for complete search history.

(56) References Cited

U.S. PATENT DOCUMENTS

| | | | | |
|---|---|---|---|---|
| 64,535 | A | | 5/1867 | Hyde |
| 127,892 | A | | 6/1872 | Kilner |
| 162,447 | A | | 4/1875 | Wilson |
| 205,002 | A | | 6/1878 | Sheldon |
| 219,844 | A | | 9/1879 | Binkard |
| 305,986 | A | | 9/1884 | Wagner |
| 441,507 | A | * | 11/1890 | Sale ..... 5/129 |
| 518,751 | A | | 4/1894 | Chambers |
| 1,921,134 | A | | 8/1933 | Rapprick |
| 2,051,254 | A | | 8/1936 | Haberstump |
| 2,121,456 | A | | 6/1938 | Tornquist |
| 2,410,088 | A | | 10/1946 | Lundquist |
| 2,560,985 | A | | 7/1951 | Rideout |
| 2,618,317 | A | | 11/1952 | Vanderminden |
| 2,649,138 | A | | 8/1953 | Rechler |
| 2,652,882 | A | | 9/1953 | Kotler |
| 2,704,569 | A | | 3/1955 | Salzer |
| 2,719,573 | A | | 10/1955 | Lesser |
| 3,593,352 | A | | 7/1971 | Britt |
| 3,783,458 | A | | 1/1974 | Westrich |
| 3,863,278 | A | | 2/1975 | Herrera |
| 4,072,341 | A | | 2/1978 | Kurz |
| 4,234,226 | A | | 11/1980 | Colby |
| 4,364,603 | A | | 12/1982 | Johnson |
| 4,456,294 | A | | 6/1984 | Lange et al. |
| 4,685,161 | A | | 8/1987 | Zalman |
| 4,691,394 | A | | 9/1987 | Woo |
| D295,242 | S | | 4/1988 | Frick et al. |
| 4,792,181 | A | | 12/1988 | Guichon |
| 4,797,961 | A | | 1/1989 | Pasquariello |
| 4,925,138 | A | | 5/1990 | Rawlins |
| 5,003,652 | A | | 4/1991 | Bayless |
| 5,046,203 | A | | 9/1991 | de Cuadros |
| 5,082,324 | A | | 1/1992 | Harada et al. |
| 5,097,546 | A | | 3/1992 | Turner, III |
| 5,109,556 | A | | 5/1992 | Cook |
| D342,841 | S | | 1/1994 | Campanello |
| 5,392,476 | A | * | 2/1995 | Williams ..... 5/127 |
| 5,414,873 | A | | 5/1995 | Wolf |

(Continued)

*Primary Examiner*—Fredrick Conley
(74) *Attorney, Agent, or Firm*—Armstrong Teasdale LLP

(57) ABSTRACT

A collapsible frame is movable between a closed configuration and an open configuration. The frame includes a first side support assembly and a second side support assembly. Each side support assembly includes a collapsible first support member including a first platform and a collapsible second support member coupled to the first support member at a plurality of pivot points. The second support member includes a support joint movable with respect to the first platform for facilitating moving the collapsible frame between the closed configuration and the open configuration.

19 Claims, 5 Drawing Sheets

U.S. PATENT DOCUMENTS 5,464,270 A 11/1995 Chang
5,498,055 A 3/1996 Goldman
5,659,907 A 8/1997 Huang
5,882,068 A 3/1999 Levine
5,983,422 A 11/1999 Bayless
6,134,724 A 10/2000 Brown
6,134,727 A 10/2000 Hwang
6,264,271 B1 7/2001 Munn et al.
6,276,008 B1 8/2001 Chen
6,296,304 B1 10/2001 Zheng
6,364,410 B1 4/2002 Tang
6,446,282 B1 9/2002 Wu
6,467,109 B1 10/2002 Wu
6,505,885 B1 1/2003 Tang
6,665,896 B1 12/2003 Tseng
6,692,068 B1 2/2004 Tang
6,698,131 B2 * 3/2004 Latschaw ..... 43/1
6,733,070 B2 5/2004 Chang
6,752,452 B2 6/2004 Choi et al.
6,763,534 B2 7/2004 Hwang
6,779,838 B2 8/2004 Chang
6,817,661 B2 11/2004 Zheng
6,817,671 B1 11/2004 Zheng
6,925,664 B1 8/2005 Twigg
6,954,950 B2 10/2005 Chen
6,966,084 B2 11/2005 LeGette et al.
2002/0043822 A1 4/2002 Choi et al.
2003/0020313 A1 1/2003 Liu
2006/0038431 A1 2/2006 Liu

* cited by examiner

PORTABLE STRUCTURE HAVING COLLAPSIBLE FRAME

BACKGROUND OF THE INVENTION

This invention relates generally to portable structures and, more particularly, to a collapsible frame for portable structures.

Conventional portable structures, such as portable chairs, beds and hammocks, are assembled to be movable between a closed configuration, for storing the structures in compact areas, and an opened configuration for supporting a person thereon.

However, such conventional structures may not be easily movable between the closed configuration and the open configuration due to complicated interconnections of the components. Further, several steps may be required to close the structure for storage or open the structure for use. Moreover, such conventional structures may require a large number of interconnected components, making the structure heavy and/or cumbersome and difficult to transport.

BRIEF DESCRIPTION OF THE INVENTION

In one aspect, a collapsible frame movable between a closed configuration and an open configuration is provided. The frame includes a first side support assembly and a second side support assembly. Each side support assembly includes a collapsible first support member including a first platform and a collapsible second support member coupled to the first support member at a plurality of pivot points. The second support member includes a support joint movable with respect to the first platform for facilitating moving the collapsible frame between the closed configuration and the open configuration.

In another aspect, a portable structure is provided. The structure includes a frame that is movable between a closed configuration and an open configuration. The frame includes a first side support assembly and a second side support assembly. Each side support assembly includes a collapsible first support member including a first platform and a collapsible second support member coupled to the first support member at a plurality of pivot points. The second support member includes a support joint movable with respect to the first platform for facilitating moving the frame between the closed configuration and the open configuration. A flexible material piece is operatively coupled to the first side support assembly and the second side support assembly.

In another aspect, a method is provided for collapsing a portable structure. The structure is movable between a closed configuration and an open configuration. The method includes providing a collapsible frame in the open configuration configured to support a flexible material piece. The collapsible frame includes a first side support assembly and a second side support assembly. The first side support assembly and the second side support assembly each includes a collapsible first support member including a first platform and a collapsible second support member coupled to the first support member at a plurality of pivot points. The second support member includes a support joint. The support joint is urged outwardly with respect to the first platform for facilitating moving the collapsible frame from the open configuration to the closed configuration.

DETAILED DESCRIPTION OF THE INVENTION

The present invention provides a portable structure, such as a hammock, having a collapsible frame configured to support a flexible material piece. Although the present invention is described below in reference to its application in connection with and operation of a portable hammock, it will be apparent to those skilled in the art and guided by the teachings herein provided that the present invention is likewise applicable to any suitable structure or apparatus including, without limitation, a portable and/or collapsible chair, couch, bed, cot or table.

Figure 1:
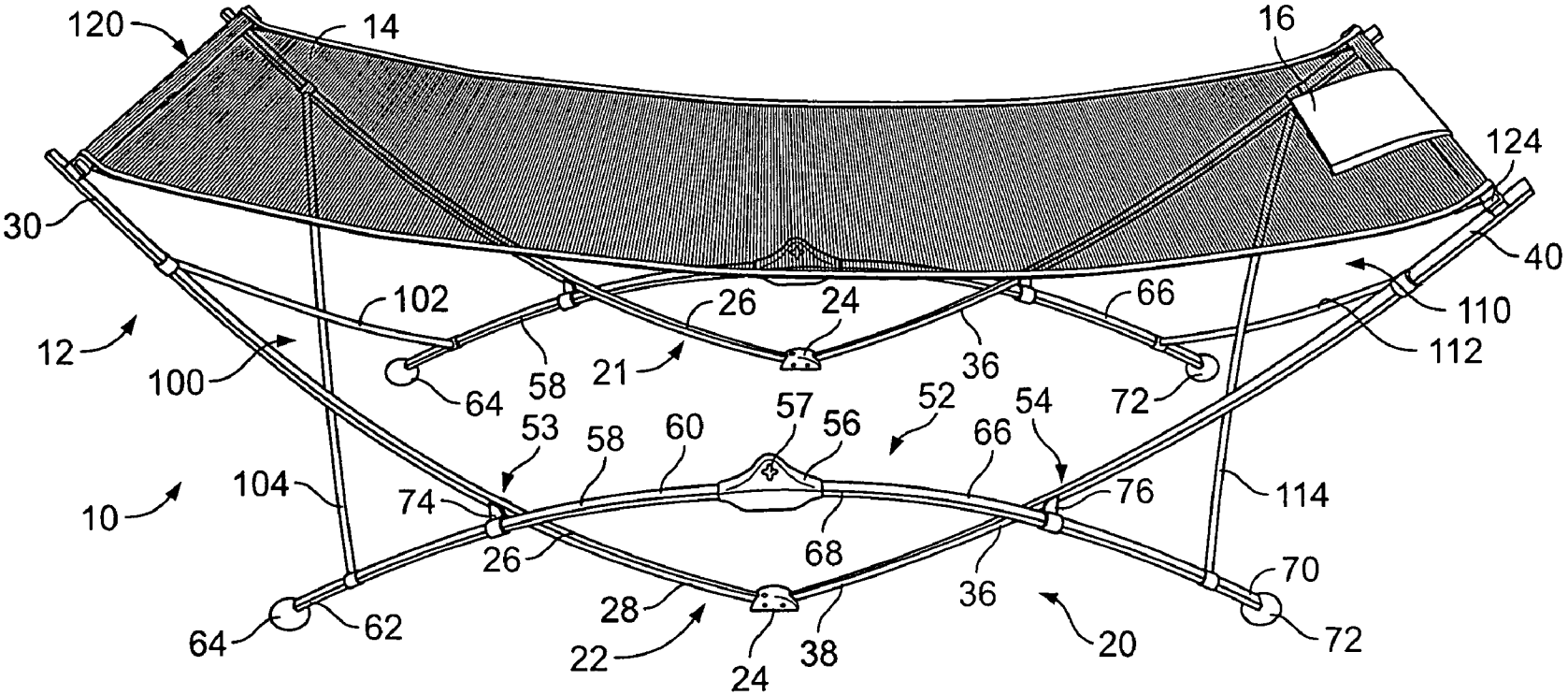
FIG. 1 is a front perspective view of a portable hammock having a collapsible frame.
Figure 2:
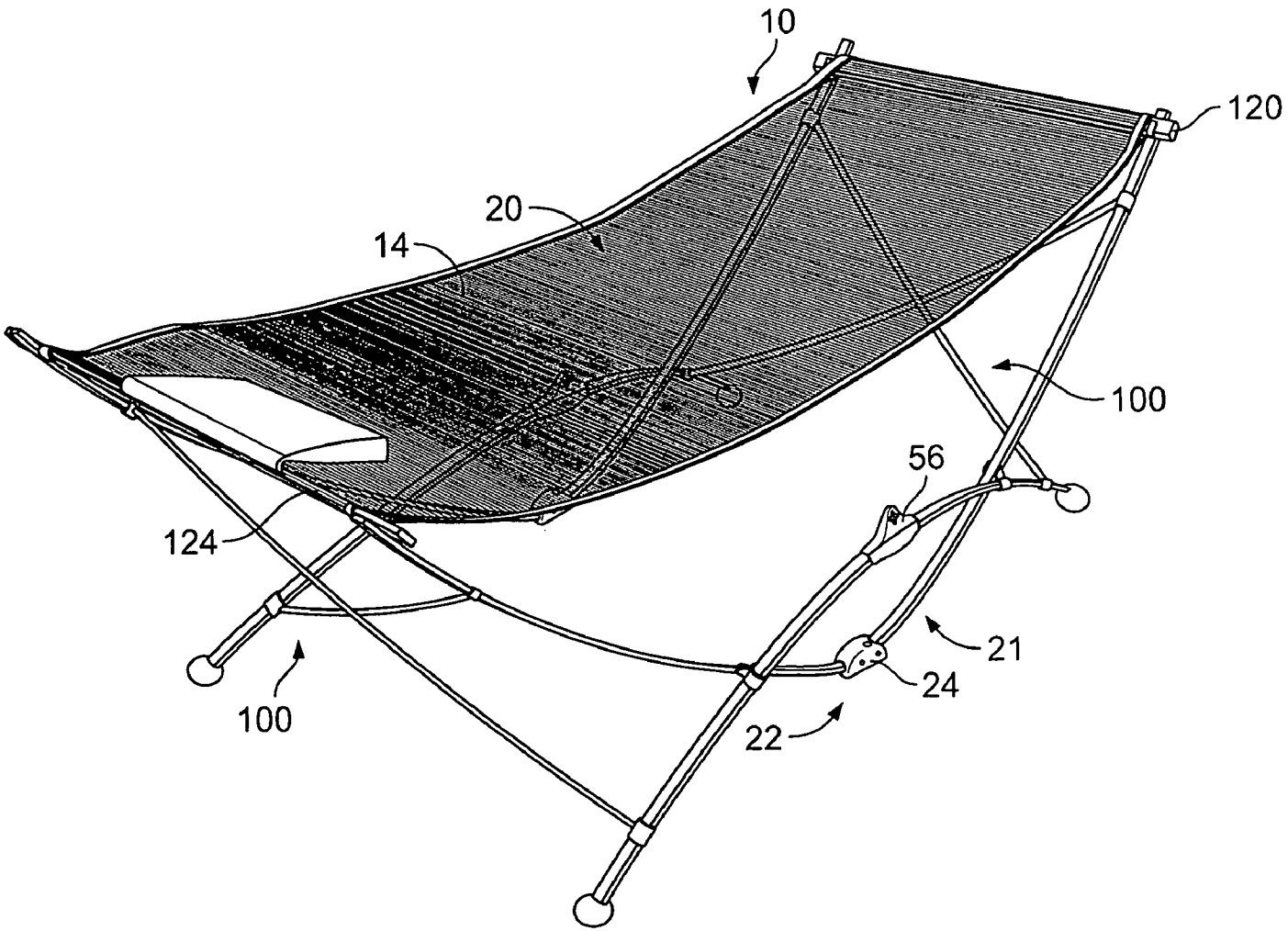
FIG. 2 is a side perspective view of the portable hammock shown in FIG. 1.

Referring to FIGS. 1-8, a portable hammock 10 is provided. Hammock 10 is supported by a collapsible or foldable frame 12 that is movable between a closed configuration and an open configuration, as shown in FIGS. 1 and 2. A suitable flexible material piece 14 is operatively coupled and supported by frame 12. In one embodiment, material piece 14 is made of a suitable fabric material. It is apparent to those skilled in the art and guided by the teachings herein provided that material piece 14 may be made of any suitable material piece that comfortably supports the weight and/or conforms to a shape of a person supported by hammock 10. In one embodiment, a pillow 16 is coupled to or integrated with material piece 14 and configured to support a person's head and/or neck when using hammock 10.

As shown in FIG. 1, frame 10 includes a first side support assembly 20 and an opposing second side support assembly 21. In one embodiment, first side support assembly 20 and second side support assembly 21 are substantially similar. Therefore, the following description of the components and/or elements are substantially similar for first side support assembly 20 and second side support assembly 21 and similar element reference numbers reference similar components and/or elements of first side support assembly 20 and second side support assembly 21.

Figure 3:
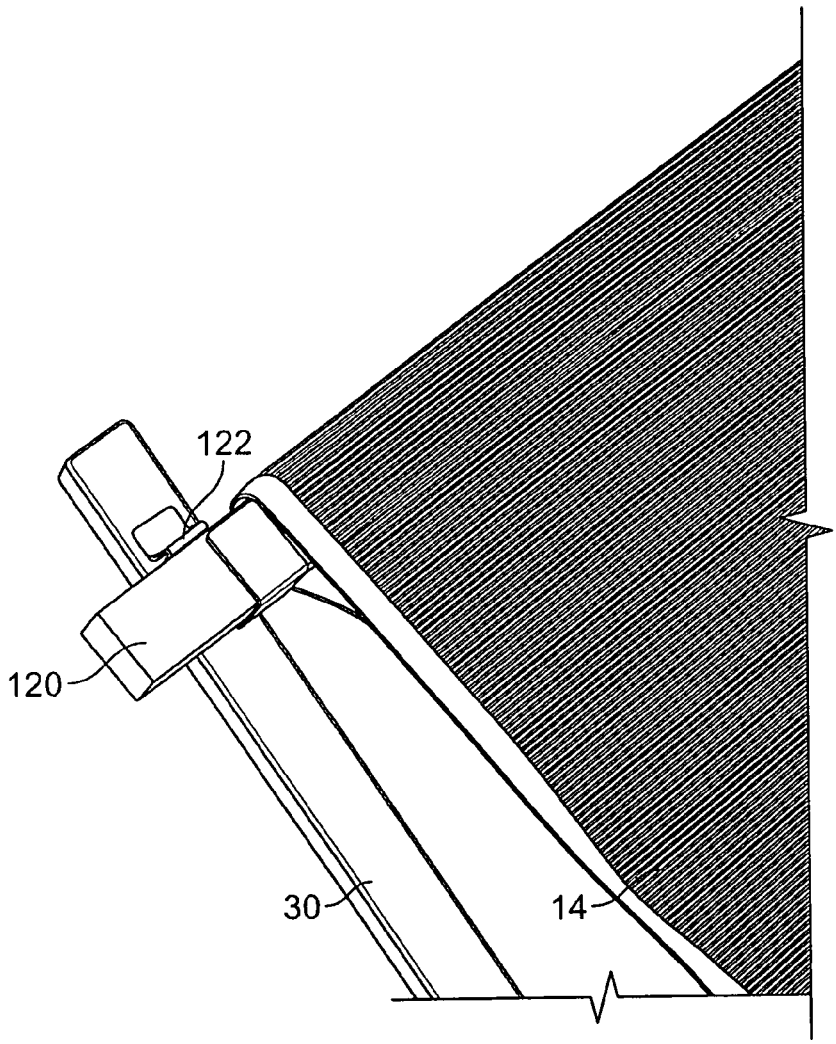
FIG. 3 is a front perspective view of a portion of the portable hammock shown in FIG. 1.
Figure 4:
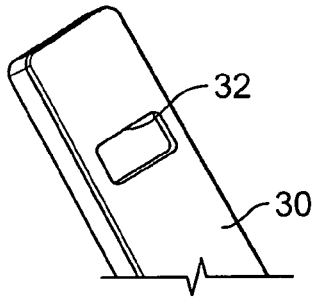
FIG. 4 is a front perspective view of a portion of the portable hammock shown in FIG. 3.

First side support assembly 20 and second side support assembly 21 each includes a collapsible or foldable first support member 22 including a first platform 24. First support member 22 includes a first portion 26 that defines a first end 28 and an opposing second end 30. In a particular embodiment, a void or opening 32, as shown in FIGS. 3 and 4, is defined within second end portion 30 for facilitating coupling a lateral support bar (as described in greater detail below) between first side support assembly 20 and second side support assembly 21.

First support member 22 also includes a second portion 36. Second portion 36 defines a first end 38 and an opposing second end 40. In a particular embodiment, a void or opening (not shown), substantially similar to void 32 shown in FIGS. 3 and 4, is defined within second end 40 for facilitating coupling a lateral support bar (as described in greater detail below) between first side support assembly 20 and second side support assembly 21. In this embodiment, first platform 24 movably couples first portion 26 to second portion 36. More specifically, first platform 24 movably couples first portion first end 28 to second portion first end 38.

Referring to FIGS. 1 and 2, first side support assembly 20 and second side support assembly 21 includes a collapsible or foldable second support member 52 coupled to first support member 22 at a plurality of pivot points 53, 54. Second support member 52 includes a support joint 56 movable with respect to first platform 24 for facilitating moving collapsible frame 12 between the closed configuration and the open configuration. In one embodiment, support joint 56 defines an opening 57 suitable for facilitating moving hammock 10 between the open configuration, as shown in FIGS. 1 and 2, and the closed configuration and/or for facilitating securely coupling an extension member to frame 12, as described in greater detail below.

Second support member 52 includes a third portion 58 that defines a first end 60 and an opposing second end 62. As shown in FIG. 1, a second platform 64 is coupled to second end 62 for facilitating stabilizing hammock 10 on a support surface, such as the ground or a patio surface, with hammock 10 in the open configuration. Second support member 52 also includes a fourth portion 66 that defines a first end 68 and an opposing second end 70. A third platform 72 is coupled to second end 70 for facilitating stabilizing hammock 10 on a support surface, such as the ground, with hammock 10 in the open configuration. In this embodiment, support joint 56 movably couples third portion 58 to fourth portion 66. More specifically, support joint 56 movably couples third portion first end 60 to fourth portion first end 68. Further, third portion 58 is coupled to first portion 26 at pivot point 53 and fourth portion 66 is coupled to second portion 36 at pivot point 54.

In one embodiment, pivot point 53 includes a collar 74 that is slidably coupled about first portion 26 and/or third portion 58 for facilitating moving hammock 10 between the open configuration and the closed configuration. Similarly, pivot point 54 includes a collar 76 slidably coupled about second portion 36 and/or fourth portion 66 for facilitating moving hammock 10 between the open configuration and the closed configuration.

As shown in FIG. 1, in one embodiment first platform 24, second platform 64 and third platform 72 are coplanar with frame 12 in the open configuration for facilitating stabilizing hammock 10 on the support surface. Further, referring to FIG. 1, in one embodiment first portion 26, second portion 36, third portion 58 and/or fourth portion 66 is arcuate. In alternative embodiments, first portion 26, second portion 36, third portion 58 and/or fourth portion 66 is generally straight. With frame 12 in the open configuration, support joint 56 of first side support assembly 20 and/or support joint 56 of second side support assembly 21 is urged away from first platform 24, such as by moving support joint 56 outwardly with respect to first platform 24, for facilitating moving frame 10 from the open configuration to the closed configuration.

As shown in FIGS. 1 and 2, in one embodiment hammock 10 includes a crossbar assembly 100. Crossbar assembly 100 includes a first crossbar 102 pivotally coupled between first portion 26 of first side support assembly 20 and third portion 58 of second side support assembly 21. A second crossbar 104 is pivotally coupled to first crossbar 102 and pivotally coupled between third portion 58 of first side support assembly 20 and first portion 26 of second side support assembly 21. In one embodiment, first crossbar 102 and/or second crossbar 104 are pivotally coupled to respective portions of the side support assemblies. In an alternative embodiment, first crossbar 102 includes a collar that is slidably positioned about first portion 26 and/or a collar that is slidably positioned about third portion 58 and/or second crossbar 104 includes a collar that is slidably positioned about first portion 26 and/or a collar that is slidably positioned about third portion 58 for facilitating moving frame 12 between the open configuration and the closed configuration.

Additionally or alternatively, hammock 10 includes a crossbar assembly 110. Crossbar assembly 110 includes a third crossbar 112 pivotally coupled between second portion 36 of first side support assembly 20 and fourth portion 66 of second side support assembly 21. A fourth crossbar 114 is pivotally coupled to third crossbar 112 and pivotally coupled between fourth portion 66 of first side support assembly 20 and second portion 36 of second side support assembly 21. In one embodiment, third crossbar 112 and/or fourth crossbar 114 are pivotally coupled to respective portions of the side support assemblies. In an alternative embodiment, third crossbar 112 includes a collar that is slidably positioned about second portion 36 and/or a collar that is slidably positioned about fourth portion 66 and/or fourth crossbar 114 includes a collar that is slidably positioned about second portion 36 and/or a collar that is slidably positioned about fourth portion 66 for facilitating moving frame 12 between the open configuration and the closed configuration.

In one embodiment, hammock 10 includes at least one support bar that is removably coupled to first side support assembly 20 and second side support assembly 21 and extends laterally therebetween. As shown in FIG. 1, a first support bar 120 is removably coupled between first portion 26 of first support member 22 of first side support assembly 20 and first portion 26 of first support member 22 of second side support assembly 21. Support bar 120 is removable for facilitating moving frame 12 between the open configuration and the closed configuration. More specifically, as shown in FIGS. 3 and 4, a bracket 122 is positionable within void 32 defined within second end 30 for facilitating coupling support bar 120 to first side support assembly 20 and second side support assembly 21. Bracket 122 is coupled to or integrated with support bar 120. Bracket 122 is inserted into void 32 and configured to interfere with at least a portion of second end 30 defining void 32 to maintain support bar 120 properly coupled to first side support assembly 20 and second side support assembly 21.

Similarly, in this embodiment a second support bar 124 is removably coupled between second portion 36 of first support member 22 of first side support assembly 20 and second portion 36 of first support member 22 of second side support assembly 21. Support bar 124 is removable for facilitating moving frame 12 between the open configuration and the closed configuration. More specifically, a bracket (substantially similar to bracket 122 shown in FIG. 3) is positionable within the void defined within second end 40 for facilitating coupling support bar 124 to first side support assembly 20 and second side support assembly 21. The bracket is coupled to or integrated with support bar 124, and inserted into the void. The bracket is configured to interfere with at least a portion of second end 40 defining the void to maintain support bar 124 properly coupled to first side support assembly 20 and second side support assembly 21. First support bar 120 and second support bar 124 are configured to support flexible material piece 14 therebetween.

Figure 5:
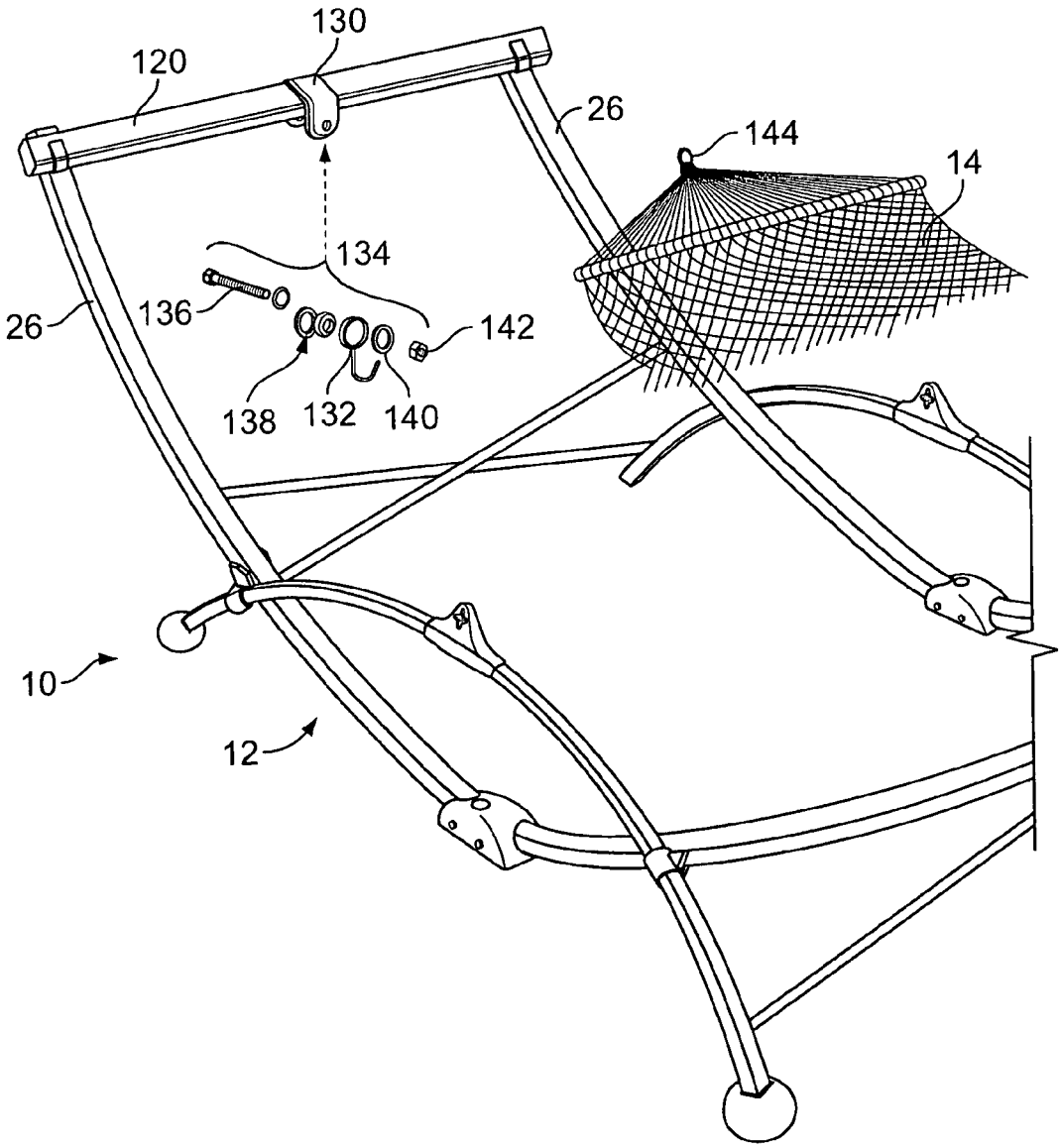
FIG. 5 is a front perspective view of a portion of a portable hammock having a collapsible frame.

Referring to FIG. 5, in an alternative embodiment material piece 14 includes a material having a lattice structure or other suitable material. In this embodiment, material piece 14 is pivotally coupled to and supported by crossbar 120 and crossbar 124 using a suitable fastener component. In a particular embodiment, a bracket 130 is secured to each crossbar 120, 124, such as by a suitable welding process. In this embodiment, a hook 132 is coupled to bracket 130 using a fastener component 134. Fastener component 134 includes a suitable bolt 136. A ball bearing casing 138 is positioned about bolt 136 and coupled to hook 132 for facilitating free rotation of hook 132 about bolt 136. A washer 140 is positioned about bolt 136 and a nut 142 is threadedly coupled to bolt 136 to secure fastening component 134 to bracket 130. As shown in FIG. 5, a loop device 144, coupled to material piece 14, is positioned on hook 132 to support material piece 14 on frame 12 and allow material piece 14 to pivot or swing with respect to a stationary frame 12. It is apparent to those skilled in the art and guided by the teachings herein provided that other suitable fastening components may be used to pivotally couple material piece 14 to frame 12. For example, a center tube support (not shown) may be positioned within bracket 130 for facilitating coupling hook 132 to crossbar 120.

Figure 6:
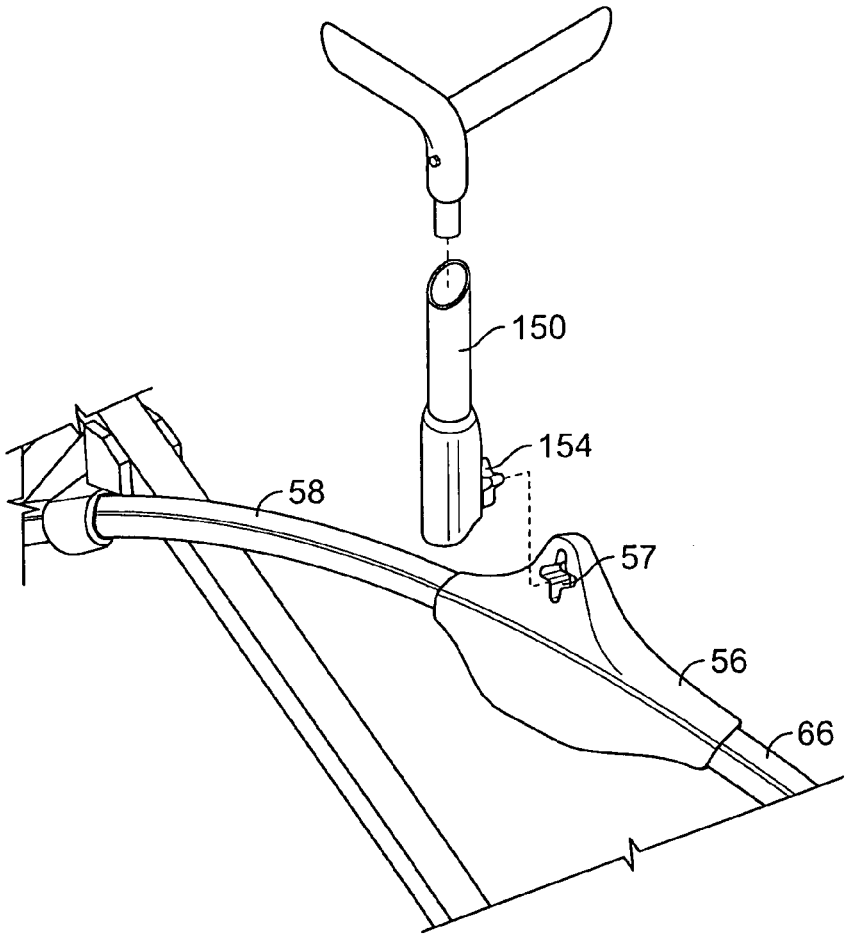
FIG. 6 is a perspective view of a portion of an extension member configured for removably coupling to the portable hammock shown in FIG. 1.
Figure 7:
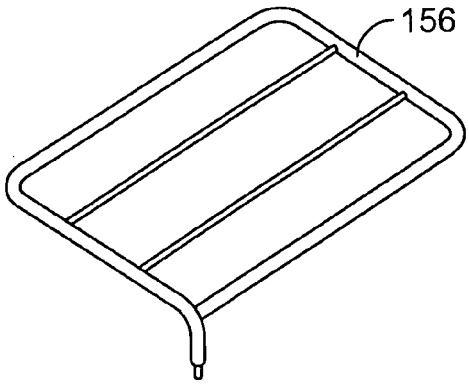
FIG. 7 is a perspective view of a planar surface configured for removably coupling to the extension member shown in FIG. 6.
Figure 8:
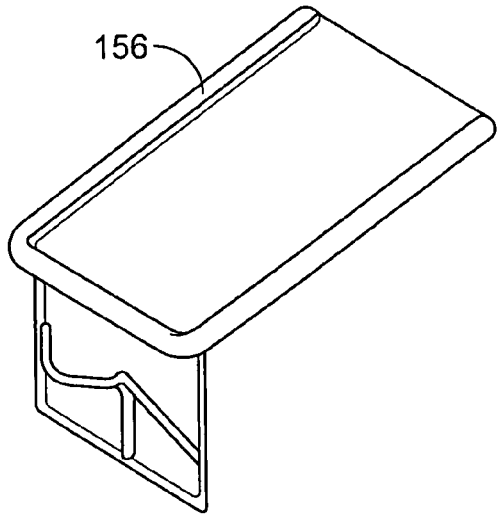
FIG. 8 is a perspective view of a planar surface configured for removably coupling to the extension member shown in FIG. 6.

In one embodiment, an extension member 150 is removably positioned within opening 57 defined by support joint 56. In a particular embodiment, opening 57 has a suitable shape that corresponds to an outer surface of extension member 150, as shown in FIG. 6. In this embodiment, the outer surface of extension member 150 includes projections and/or undulations 154 that frictionally fit within opening 57 to limit or prevent undesirable rotation and/or movement of extension member 150 within opening 57. As shown in FIGS. 7 and 8, extension member 150 includes a planar surface 156, such as table or desk, which is suspended over material piece 14 and configured to support objects, such as books and/or food items with hammock 10 in the open configuration. Extension member 150 including planar surface 156 may be coupled to first side support assembly 20 or second side support assembly 21. In alternative embodiments, extension member 150 and/or planar surface 156 is rotatable. Further, extension member 150 may include a compartment for storing articles or objects, such as books, eye glasses, insulated cups and/or bottles. Extension member 150 is removable from opening 57 for facilitating moving frame 12 between the open configuration and the closed configuration. With extension member 150 removed from within opening 57, a user can utilize opening 57, such as by inserting an object into opening 57, for facilitating moving support joint 56 outwardly with respect to first platform 24 to move frame 12 between the open configuration and the closed configuration.

In one embodiment, a method is provided for collapsing or folding a portable hammock. In this embodiment, the hammock is movable between a closed configuration and an open configuration. The hammock includes a collapsible frame in the open configuration configured to support a person positioned on a flexible material piece. The collapsible frame has a first side support assembly and a second side support assembly. The first side support assembly and the second side support assembly include a collapsible first support member including a first platform and a collapsible second support member coupled to the first support member at a plurality of pivot points. The second support member includes a support joint. The support joint is urged or moved outwardly with respect to the first platform for facilitating moving the collapsible frame from the open configuration to the closed configuration.

The above-described portable hammock having a collapsible frame allows a lightweight hammock to be made having fewer components, while maintaining suitable stability for supporting a user. Further, the collapsible frame includes a support joint that is easily urged or moved outwardly with respect to a first platform for facilitating folding the frame from the open configuration to the closed configuration.

Exemplary embodiments of a portable hammock having a collapsible frame, as well as a method for collapsing or folding the hammock frame, are described above in detail. The apparatus and method is not limited to the specific embodiments described herein, but rather, components of the apparatus and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A collapsible frame movable between a closed configuration and an open configuration, said frame comprising:

a first side support assembly;

a second side support assembly coupled to said first side support assembly, each of said first side support assembly and said second side support assembly extendable with respect to a longitudinal axis of symmetry of said collapsible frame such that said second side support assembly opposes said first side support assembly along the longitudinal axis of symmetry, each of said first side support assembly and said second side support assembly comprising:

a collapsible first support member including a first platform, said first support member comprising a first portion and a second portion, said first platform movably coupling said first portion to said second portion; and a collapsible second support member comprising a third portion and a fourth portion, and a support joint movably coupling said third portion to said fourth portion, said third portion coupled to said first portion at a first pivot point of a plurality of pivot points and said fourth portion coupled to said second portion at a second pivot point of said plurality of pivot points, said first pivot point comprising a first collar slidably coupled about at least one of said first portion and said third portion, and said support joint movable with respect to said first platform for facilitating moving the collapsible frame between the closed configuration and the open configuration.

2. A collapsible frame in accordance with claim 1 wherein said frame is configured to move from the open configuration to the closed configuration when said support joint is moved outwardly with respect to said first platform.

3. A collapsible frame in accordance with claim 1 wherein said support joint defines an opening, said frame further comprising an extension member removably positioned within said opening.

4. A collapsible frame in accordance with claim 1 wherein said first portion defines a first end and an opposing second end, and said second portion defines a first end and an opposing second end, said first platform movably coupling said first portion first end to said second portion first end.

5. A collapsible frame in accordance with claim 1 further comprising a crossbar assembly, said crossbar assembly comprising:

a first crossbar pivotally coupled between said first portion of said first side support assembly and said third portion of said second side support assembly; and a second crossbar pivotally coupled to said first crossbar and pivotally coupled between said third portion of said first side support assembly and said first portion of said second side support assembly.

6. A collapsible frame in accordance with claim 1 wherein said third portion defines a first end and an opposing second end, and said fourth portion defines a first end and an opposing second end, said support joint movably coupling said third portion first end to said fourth portion first end.

7. A collapsible frame in accordance with claim 6 further comprising a second platform coupled to said third portion second end and a third platform coupled to said fourth portion second end, said first platform, said second platform and said third platform coplanar with said frame in the open configuration.

8. A collapsible frame in accordance with claim 1 wherein at least one of said first portion, said second portion, said third portion and said fourth portion is arcuate.

9. A collapsible frame in accordance with claim 1 wherein said second pivot point further comprises a second collar slidably coupled about at least one of said second portion and said fourth portion.

10. A collapsible frame in accordance with claim 1 further comprising:

a first support bar removably coupled between said first portion of said first side support assembly and said first portion of said second side support assembly; and a second support bar removably coupled between said second portion of said first side support assembly and said second portion of said second side support assembly, said first support bar and said second support bar configured to support a flexible material piece therebetween.

11. A collapsible frame in accordance with claim 10 further comprising:

a void defined within each said first portion; and a bracket removably positionable within said void, said bracket removably coupling said first support bar to each said first portion.

12. A collapsible frame in accordance with claim 10 further comprising:

a void defined within each said second portion; and a bracket removably positionable within said void, said bracket removably coupling said second support bar to each said second portion.

13. A portable structure comprising:

a collapsible frame movable between a closed configuration and an open configuration, said frame comprising a first side support assembly coupled to a second side support assembly, each of said first side support assembly and said second side support assembly extendable with respect to a longitudinal axis of symmetry of said collapsible frame such that said second side support assembly opposes said first side support assembly along the longitudinal axis of symmetry, each of said first side support assembly and said second side support assembly comprising:

a collapsible first support member including a first platform, said first support member comprising a first portion and a second portion, said first platform movably coupling said first portion to said second portion; and a collapsible second support member comprising a third portion and a fourth portion, and a support joint movably coupling said third portion to said fourth portion, said third portion coupled to said first portion at a first pivot point of a plurality of pivot points and said fourth portion coupled to said second portion at a second pivot point of said plurality of pivot points, said first pivot point comprising a first collar slidably coupled about at least one of said first portion and said third portion, and said support joint movable with respect to said first platform for facilitating moving the collapsible frame between the closed configuration and the open configuration; and a flexible material piece operatively coupled to each of said first side support assembly and said second side support assembly.

14. A portable structure in accordance with claim 13 further comprising a crossbar assembly, said crossbar assembly comprising:

a first crossbar pivotally coupled between said first portion of said first side support assembly and said third portion of said second side support assembly; and a second crossbar pivotally coupled to said first crossbar and pivotally coupled between said third portion of said first side support assembly and said third portion of said second side support assembly.

15. A portable structure in accordance with claim 13 further comprising:

a first support bar removably coupled between said first portion of said first side support assembly and said first portion of said second side support assembly, a first end of said flexible material piece one of rotatably and fixedly coupled to said first support bar; and a second support bar removably coupled between said second portion of said first side support assembly and said second portion of said second side support assembly, a second end of said flexible material piece one of rotatably and fixedly coupled to said second support bar, said first support bar and said second support bar configured to support said flexible material piece therebetween.

16. A portable structure in accordance with claim 15 further comprising:

a first void defined within each said first portion;

a first bracket removably positionable within said first void, said first bracket removably coupling said first support bar to each said first portion;

a second void defined within each said second portion; and a second bracket removably positionable within said second void, said second bracket removably coupling said second support bar to each said second portion.

17. A portable structure in accordance with claim 13 wherein said support joint defines an opening, said frame further comprising an extension member removably positioned within said opening.

18. A portable structure in accordance with claim 17 further comprising a planar surface coupled to said extension member and configured for supporting objects.

19. A method for collapsing a portable structure, the structure movable between a closed configuration and an open configuration, said method comprising:

providing a collapsible frame in the open configuration configured to support a flexible material piece, the collapsible frame comprising a first side support assembly coupled to a second side support assembly, each of said first side support assembly and said second side support assembly extendable with respect to a longitudinal axis of symmetry of said collapsible frame such that said second side support assembly opposes said first side support assembly along the longitudinal axis of symmetry, each of the first side support assembly and the second side support assembly comprising a collapsible first support member including a first platform, the first support member comprising a first portion and a second portion, the first platform movably coupling the first portion to the second portion, and a collapsible second support member comprising a third portion and a fourth portion, and a support joint movably coupling the third portion to the fourth portion, the third portion coupled to the first portion at a first pivot point of a plurality of pivot points and the fourth portion coupled to the second portion at a second pivot point of the plurality of pivot points, and the first pivot point comprising a first collar slidably coupled about at least one of the first portion and the third portion; and urging the support joint outwardly with respect to the first platform for facilitating moving the collapsible frame from the open configuration to the closed configuration.

* * * * *